US007367074B1

(12) United States Patent
Bergquist

(10) Patent No.: US 7,367,074 B1
(45) Date of Patent: May 6, 2008

(54) CUSTOMIZED MOLDED ORTHOTIC SHOE INSERT METHOD AND APPARATUS

(76) Inventor: Mark C. Bergquist, 1823 Belknap St., Superior, WI (US) 54880

( * ) Notice: Subject to any disclaimer, the term of this patent is extended or adjusted under 35 U.S.C. 154(b) by 315 days.

(21) Appl. No.: 11/334,299

(22) Filed: Jan. 19, 2006

(51) Int. Cl.
*A43B 13/38* (2006.01)

(52) U.S. Cl. ..... 12/142 N; 12/146 M; 36/140; 36/166

(58) Field of Classification Search ..... 12/142 N, 12/146 M, 142 R; 36/88, 140, 154, 166
See application file for complete search history.

(56) References Cited

U.S. PATENT DOCUMENTS 4,979,252 A * 12/1990 Daley ..... 12/142 N
5,015,427 A 5/1991 Sosnow
5,027,461 A * 7/1991 Cumberland ..... 12/142 N
5,640,779 A * 6/1997 Rolloff et al. ..... 33/514.2
6,000,082 A * 12/1999 Nguyen ..... 12/142 N
7,008,386 B2 * 3/2006 Alaimo et al. ..... 600/592

FOREIGN PATENT DOCUMENTS

US 2002/0183660 A1 12/2002
US 2004/0194348 A1 10/2004

OTHER PUBLICATIONS

PCT/AU03/00034, Jan. 15, 2003, Rodney Kielt.
PCT/AU91/00185, Apr. 30, 1991, Phillip John Vasyli.

* cited by examiner

*Primary Examiner*—Marie Patterson
(74) *Attorney, Agent, or Firm*—Harpman & Harpman

(57) ABSTRACT

A method system of custom forming orthotic shoe inserts adapted for use in multiple shoe types. The method steps to fit, form and fabricate custom inserts directed to individual patient requirements using heat malleable synthetic resin material in combination with removably secured overlying foot engagement pad and selective secured remedial arch pad directing the so-formed orthotic support.

7 Claims, 9 Drawing Sheets

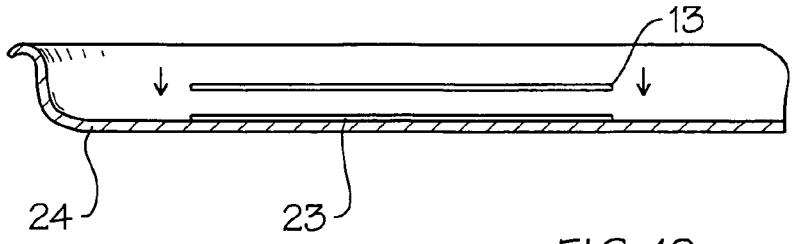
FIG. 12
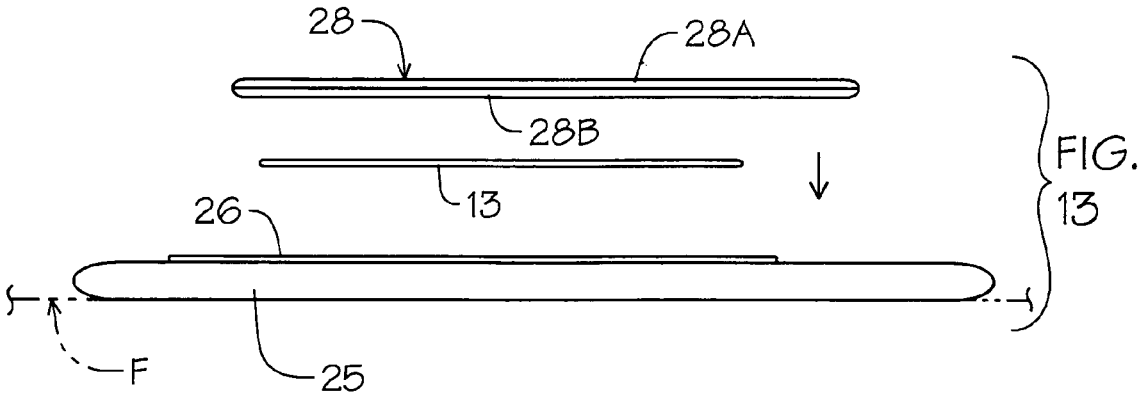

CUSTOMIZED MOLDED ORTHOTIC SHOE INSERT METHOD AND APPARATUS

BACKGROUND OF THE INVENTION

1. Technical Field

This invention relates to customized molded orthotic devices specifically designed for corrective therapeutic treatment of foot, knee, hip, pelvic and spinal dysfunctional ailments promoting proper biomechanical function in the foot, knee, hip, pelvis and spine.

2. Description of Prior Art

Prior art customized molded orthotic devices have been developed in conjunction with the use of orthotic labs to be used with shoes to provide a custom contoured low profile fixture to fit the planar surface of the foot. Initially, such devices were formed from metal and leather with later material advances currently using heat formed synthetic or molded synthetic resin material to custom fit for each patient. This system could only be produced by orthotic labs where all the shaping and construction of the custom molded orthotic plate took place. Such hard plastic fixtures use a custom mold taken from the patient's foot in combination with constructive contouring to supplement the needed therapeutic treatment and correction of such devices. Such custom orthotics are typically designed for use in the primary shoe of the patient and thus limits their use. Most practitioners make only impressions of a patient's foot, which then are shipped to an orthotic lab. Orthotic labs receive the impression and create casts of the foot with plaster which takes much time and energy to build and form. Other models are pre-molded and are fitted according to the size of foot. Pre-molded orthotics cannot give customized foot support which is mandatory for optimal biomechanical joint function.

A variety of prior art devices have been developed for such orthotics, see for example U.S. Pat. No. 5,015,427, Patent Publications 2002/018360A1 and 2004/0194348AN and PCT Patent Publications PCT/AU91/00185 and PCT/AU03/0034.

In U.S. Pat. No. 5,015,427 a process is disclosed for making an orthotic footwear insert made of a resilient shock absorbing layer to be positioned in the heel receiving area of the shoe.

U.S. Patent Publication 2002/0183 60A1 discloses the use of a heating mat to manufacture a custom orthotic device by heating up a sheet of flexible heat deformable material then applying it to the shaped part of a patient's body.

U.S. Patent Publication 2004/0194348AN illustrates a heat malleable orthotic shoe insert in which a cuffed heel portion is combined with a deformable mid-foot portion having a medial longitudinal arch and a deformable upper bearing surface. This insert requires that a heated mid-foot portion be engaged and pushed down upon by the patient's foot to form the impression therein.

PCT patent application publication AU91/00185 defines an orthotic device for the foot which is preshaped by use of a template cast to fit the patient's foot.

PCT patent application publication AU03/0034 outlines an orthotic insert is formed by combining two portions of material of different densities placed in a mold under heat and pressure. Once formed and cooled, the compound insert is then reheated and placed in the shoe of the patient who then pushes down thereagainst conforming the insert to the patient's foot.

SUMMARY OF THE INVENTION

A method and process of forming custom molded foot orthotics using a multiple step process that includes precise location of critical structural features of a patient's foot and the fabrication of the foot orthotic. This orthotic system is fabricated "in house" from start to finish and can be accomplished at the practitioner's office without the need of an orthotic lab. This is a direct molding procedure eliminating the use of plasters and all the various steps used in indirect molding of orthotics. A heat deformable material is pressed upward superiorly with the practitioner's hands and fingers against the medial and lateral longitudinal arches of the foot independent of a patient's weight deforming by transferring to provide a truly custom and efficient support portion of the medial and lateral portions of the weight bearing foot orthotics. The hindfoot is pressed superiorly on both sides to form a custom fit around the heel. This new customized orthotic procedure save time and cost and bypasses all the various steps of typical molding techniques. In 20-30 minutes this direct mold orthotic can be built from start to finish.

DESCRIPTION OF THE DRAWINGS

FIG. 12 is an exploded partial sectional side elevational view illustrating portions of an orthotic blank to be positioned on a non-stick tray to be heated;

FIG. 13 is an exploded side elevational view of positioning of the heated orthotic blank on a flexible foam placemat prior to deformation;

Figure 17:
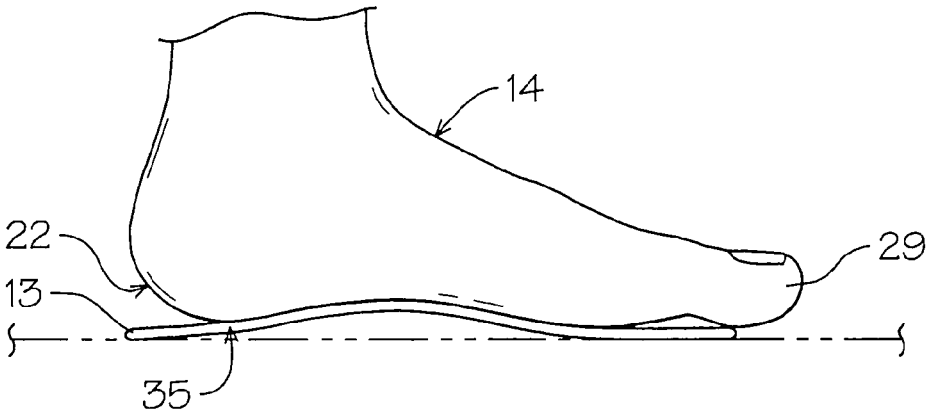
Figure 18:
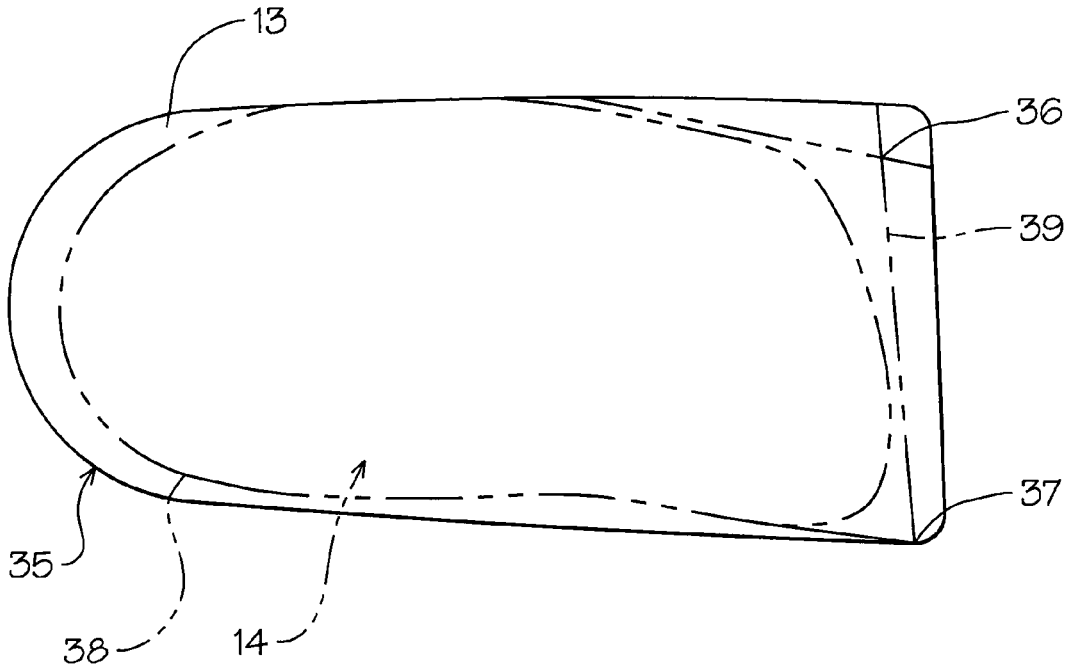

(not shown) on the metatarsal-phalangeal joints to complete the deformation of the orthotic blank;

FIG. 17 is a left medial side elevational graphic representation that illustrates the repositioned alignment of the patient's foot on a cooled formed orthotic plate for final tracing of the foot's perimeter thereon; and FIG. 18 is a top plan view of the formed orthotic plate with the patient's foot outlined thereon for final trimming and preparation.

DETAILED DESCRIPTION OF THE INVENTION

Figure 10:
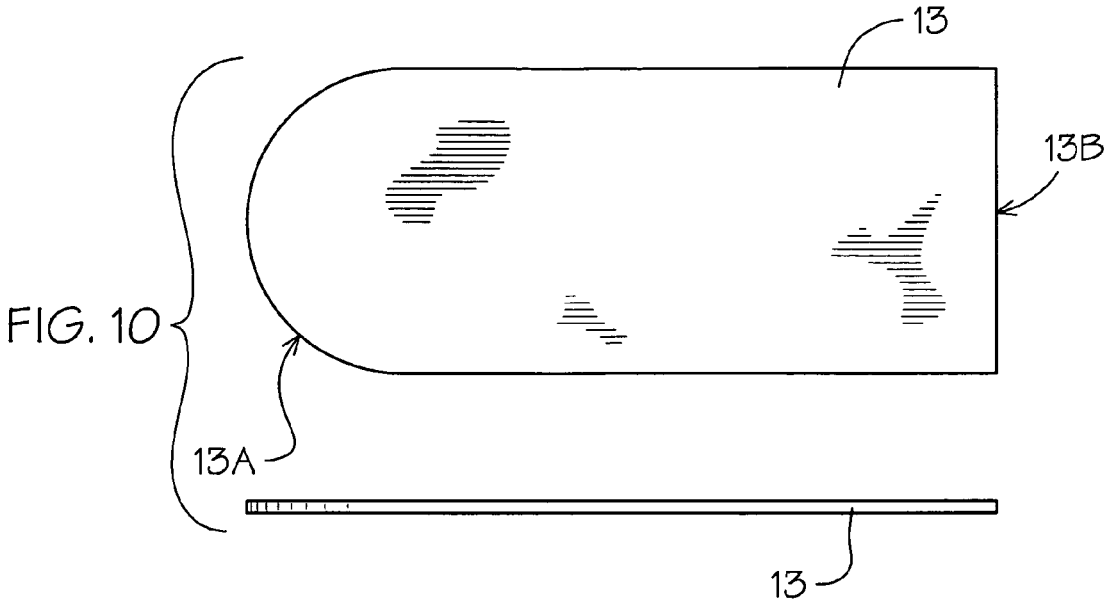
FIG. 10 is a top plan view and a side elevational view of an orthotic synthetic resin orthopedic reinforcement plate material (orthotic blank) before forming.

Referring now to FIGS. 1-3 and 6 of the drawings, a molded foot orthotic 10 of the invention can be seen having a contoured support shell portion 11 and a soft top foot engagement portion 12. The contoured support shell 11 is molded from a synthetic material orthotic blank 13, best seen in FIG. 10 of the drawings which is malleable when heated retaining its configured shape once cooled. The orthotic blank 13 has an arcuate end 13A and an oppositely disposed straight end 13B.

To prepare a custom foot orthotics 10 of the invention, a patient's foot 14 is first examined by the practitioner to determine the position of specific physical attributes associated therewith and accordingly mark same on the foot 14 as follows and illustrated in FIGS. 7, 8, 9 and 11 of the drawings.

Figure 7:
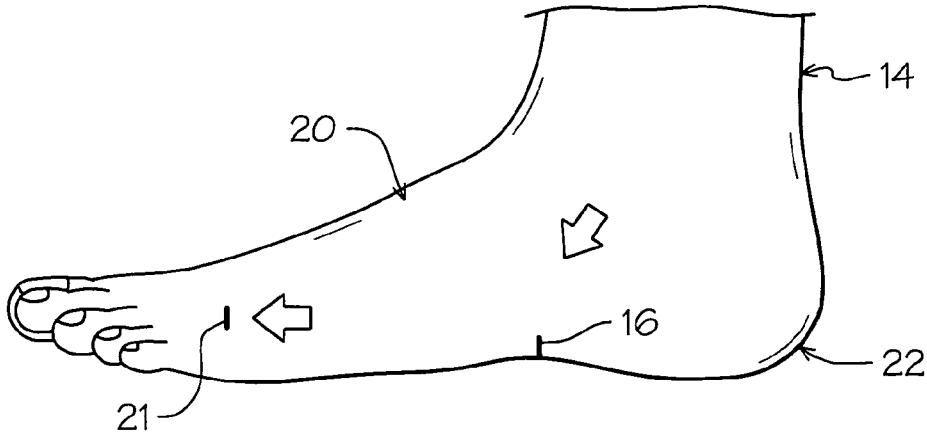
FIG. 7 is a graphic left lateral side elevational view representation of a patient's foot being marked for the lateral longitudinal arch and fifth metatarsal-phalangeal joint.
Figure 11:
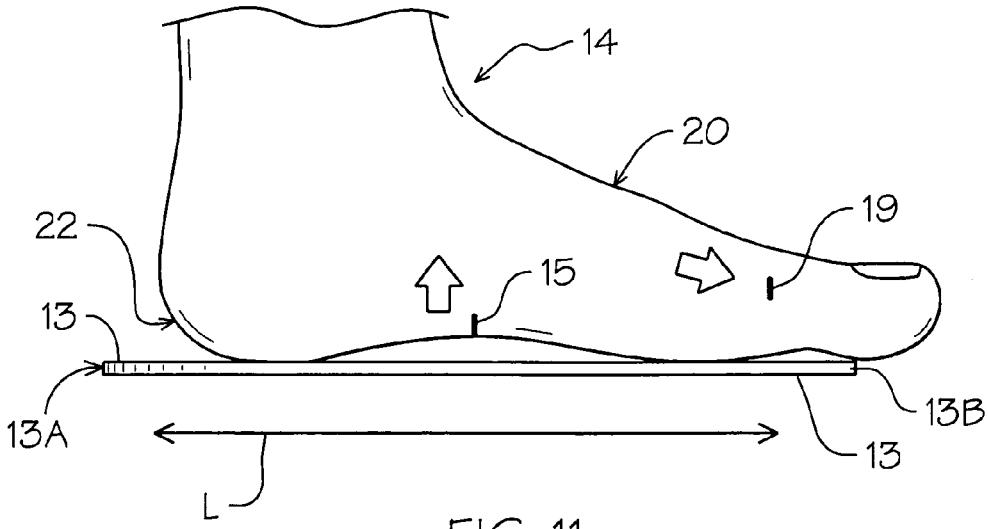
FIG. 11 is a graphic medial side elevational representation of a patient's left foot marked for the medial longitudinal arch and the first metatarsal-phalangeal joint.

Referring to FIGS. 7 and 11 of the drawings, the medial longitudinal arch at 15 "inside arch" is the highest central point of the medial longitudinal arch. The lateral longitudinal arch at 16 "outside arch" marking same for future reference is the highest centered point of the lateral longitudinal arch.

Figure 8:
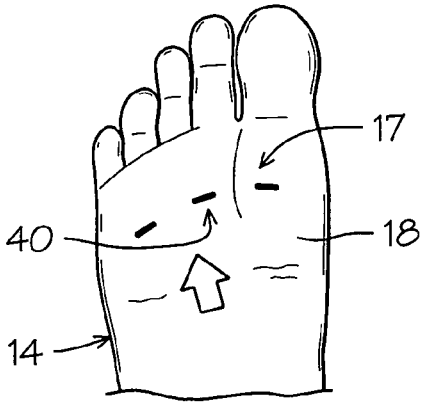
FIG. 8 is a graphic partial bottom plan view of a patient's left foot being marked for the distal portion of the metatarsal bones.
Figure 9:
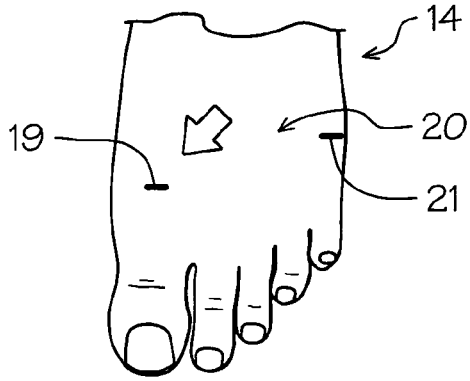
FIG. 9 is a graphic partial top plan view of a patient's left foot marked for the first and fifth metatarsal-phalangeal joint.

The practitioner then locates and marks the distal posterior portion of the metatarsal bones 17 in FIG. 8 of the drawings on the bottom 18 of the foot 14. The first metatarsal phalangeal joint at 19 shown in FIGS. 9 and 11 of the drawings is then located and marked on the top 20 of the foot 14 as well as the fifth metatarsal-phalangeal head at 21 best seen in FIG. 7 of the drawings.

To determine the correct size of the orthotic blank 13 to be used, the patient's foot 14 is placed thereon as seen in FIG. 11 of the drawings so as to extend from the back of a heel portion 22 to the hereinbefore described first metatarsal-phalangeal joint at 19 as indicated by size line arrow indicator L.

Referring now to FIG. 12 of the drawings, the preselected orthotic blank 13 is then prepared for heating in a convection oven (not shown) by placing on a silicone sheet 23 and then onto a non-stick transportation tray 24. The orthotic blank 13 is then heated in the convection oven at 400 degrees Fahrenheit for a predetermined time to impart malleability which is typically four to five minutes in most applications.

For positioning and forming of the orthotic blank 13 a flexible slow recovery foam material mat 25 with a second sheet of silicone material 26 thereon is placed on the floor F indicated in broken lines for alignment with the patient's foot 14 from a sitting position in which the lower leg 27 shown in broken lines and the foot 14 is orientated on a vertical plane in 90 degrees angular relationship to the patient's upper leg portion (not shown) in the hereinbefore described sitting position.

Figure 14:
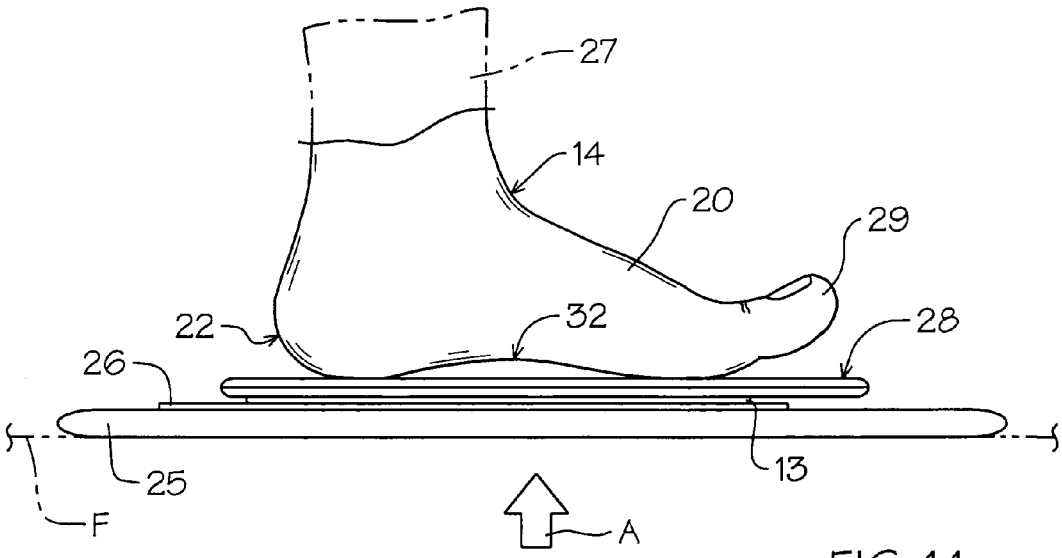
FIG. 14 is a graphic side elevational view of the patient's left foot positioned on the orthotic blank and support assembly set for deformation.
Figure 15:
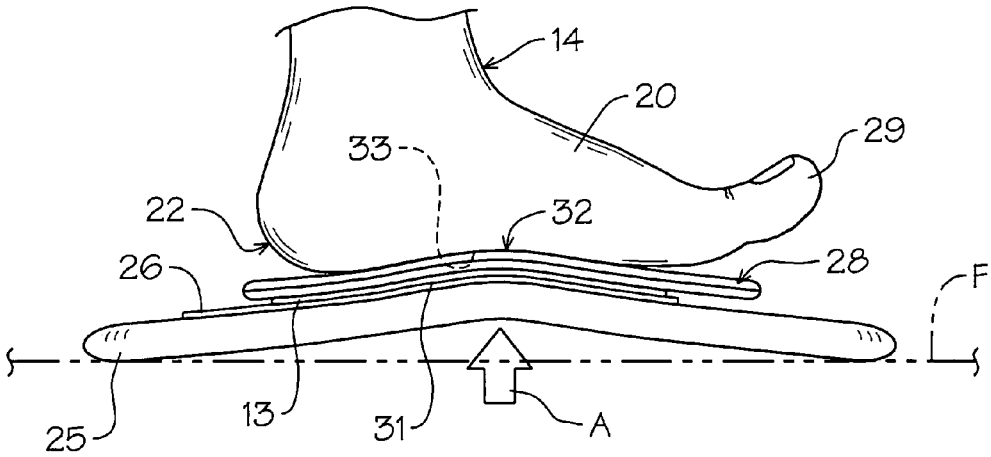
FIG. 15 is a graphic side elevational left view of the patient's left foot representing the applied upward force by the practitioner deforming the orthotic blank against the patient's left medial longitudinal arch.

The heated and now malleable orthotic blank 13 with its silicone sheet 23 is removed from the convection oven and immediately placed on the second silicone sheet 26 on the mat 25. A heat protection pad 28 defining a barrier for the foot is formed of a bi-layer construction of slow recovery insulating foam material 28A and a silicone sheet 28B glued together and positioned for aligned engagement on top of the heated orthotic blank 13. If the patient's Achilles tendon is perpendicular to the floor F and not bowing, the knees, not shown, should be directly above the foot. If the Achilles tendons are bowing inward, the practitioner slightly moves the knee laterally outward in relation to the foot. This will form a medial heel wedge in the molding process. If the Achilles tendon is bowing outward, the practitioner moves the knee medial. This will form a lateral heel wedge in the molding process. The degree of the spreading or approximating of the knee is directly proportional to the degree of inward/outward bowing of the Achilles tendon. The patient is instructed to raise their toes 29 upwardly for engagement thereon as seen in FIG. 14 of the drawings. The raising of the toes maximizes the medial and lateral longitudinal arch but is not mandatory. If the practitioner desires a lesser longitudinal arches, the patient is instructed to keep the toes down (flat). Given that the orthotic material blank 13 will stay malleable for only fifteen to thirty seconds after removal from the oven, the practitioner must move quickly. After it is determined whether to maximize the arches or not the practitioner must place his hands at the bottom of the medial and lateral arches positions. The practitioner then applies upward superior pressure against the foam material mat 25 and the medial longitudinal arch position of the foot (represented by force arrow A in FIG. 15 of the drawings) and the lateral longitudinal arch of the foot at 32 to form a corresponding "outside" lateral arch at 33 shown in broken lines in the orthotic blank 13 thus forming by manual manipulation a medial longitudinal arch 31 portion and the lateral longitudinal on the orthotic blank 13. Superior upward pressure with the practitioner's hands is also applied to both the medial and lateral sides of the heel to form a customized heel cup for the patient.

Figure 16:
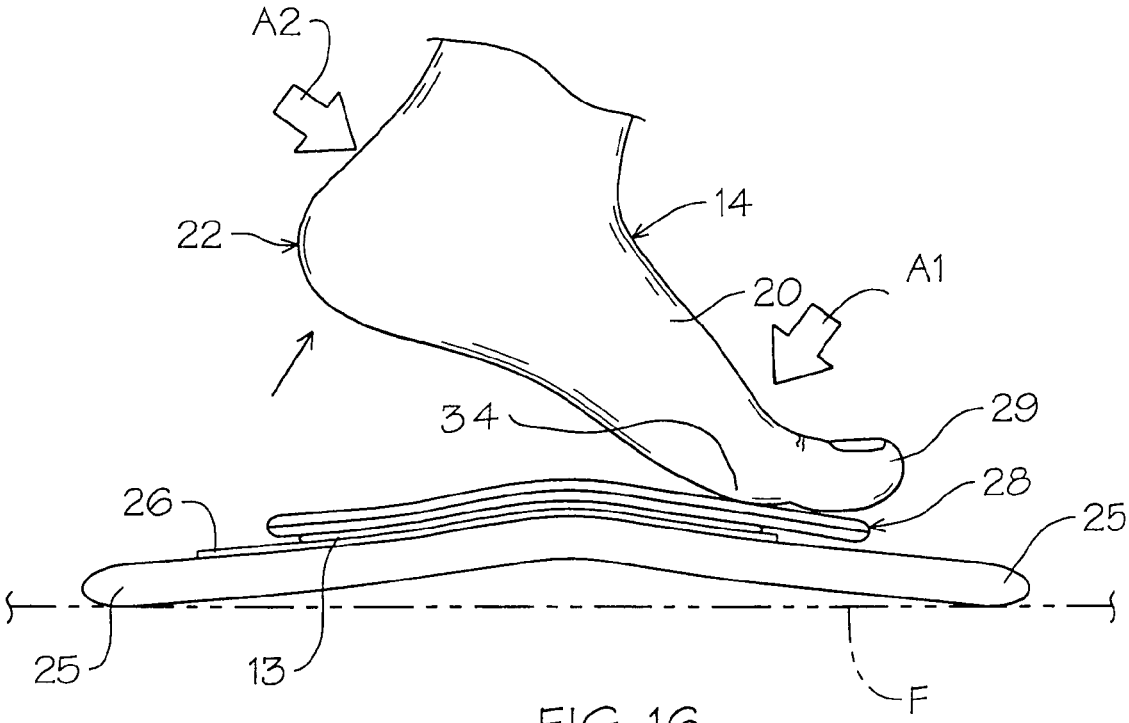
FIG. 16 is a graphic side elevational view illustrating the foot bringing the heel up from the surface with applied downward pressure by a health professional "practitioner"

To complete the forming process, the practitioner instructs the patient to quickly lift their heel 22 putting equal pressure (indicated by force arrow A1) on the ball of the foot 34 while being stabilized by the practitioner's hands presented by force arrow A2 in FIG. 16 of the drawings. Alternately, the practitioner can instruct the patient to keep the foot neutral while downward pressure is placed on the superior distal metatarsal heads of the foot 14. This downward pressure whether the heels are up or down helps flatten the mid and forefoot portion of the orthotic blank 13 to prevent rocking and tipping to one side.

The now newly formed custom orthotic plate 35 is removed and cooled typically by running water to set thermally as will be well known and understood by those skilled in the art.

To complete the fit/forming process of the invention, the patient's foot 14 is then repositioned on the cooled configured orthotic plate 35 under the guidance of the practitioner and comfortably positioned to maximize the medial and lateral longitudinal arches. The practitioner then proceeds to mark the configured orthotic plate 35 based first on the positioning of the first metatarsal phalangeal joint 19 in FIG. 11 of the drawings and then the fifth metatarsal phalangeal joint 21 see FIG. 7 of the drawings, these positions having been determined previously and generally illustrated in FIGS. 7, 11, 19 and 21 of the drawings. An outline 38 of the so engaged foot 14 is then traced onto the configured orthotic plate 35 with a straight line at 39 applied to and extending transversely between the so marked 36 and 37 (the first 19 and fifth 21 metatarsal phalangeal joint) as seen in broken lines in FIG. 18 of the drawings. The thus marked configured orthotic plate 35 is then trimmed and sanded by use of power tools and hand application resulting in the finished exterior shape indicated in trace broken lines 38 in FIG. 18 of the drawings and solid lines generally in FIGS. 1-3 of the drawings.

Figure 1:
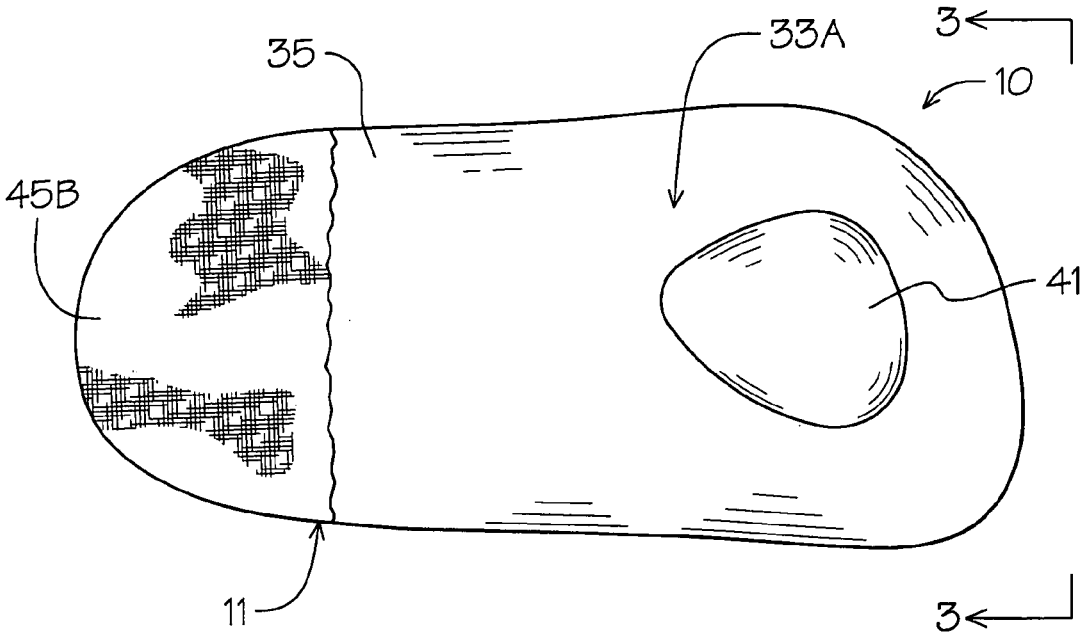
FIG. 1 is a top plan view of the contoured molded left orthotic hard shell portion of the invention.
Figure 2:
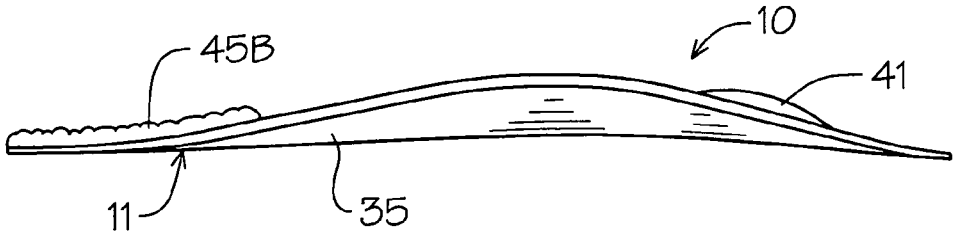
FIG. 2 is a side elevational view thereof.
Figure 3:
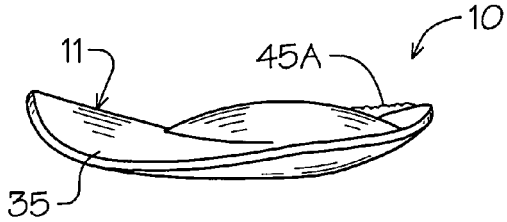
FIG. 3 is a front elevational view on lines 3-3 of FIG. 1.

Referring back to FIG. 8 of the drawings, the patient's foot 14 is now re-marked on the foot's bottom surface 18 outlining the first, third, and fifth distal tarsal heads indicated at 40 using a transfer dye marker. The configured orthotic plate 35 is then quickly applied and held against the bottom 18 of the patient's foot 14 to affect a marking transfer thereon. This step transfers the indicia marks indicating the relative position of the patient's transverse arch on the upper surface 33A of the configured orthotic plate 35. A transverse arch pad 41, well known in the art, having a contoured raised upper surface is selected based on the approximate required size and position and it is adhesively attached to the configured orthotic plate 35 upper surface 33A as illustrated in FIGS. 1-3 of the drawings. It will be noted that transverse arch pad 41 comes in a variety of shapes and sizes and must be placed beyond the distal portion of the metatarsal heads as hereinbefore described.

Figure 4:
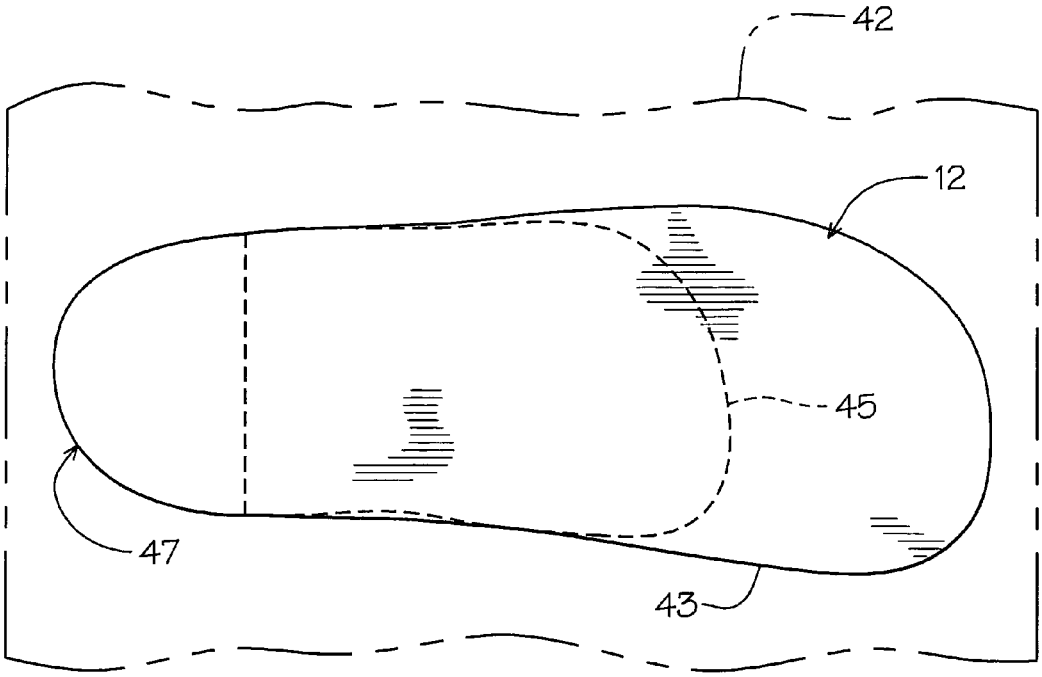
FIG. 4 is a top plan view of the custom soft top that is placed over the contoured molded orthotic shell shown in FIG. 1.
Figure 5:
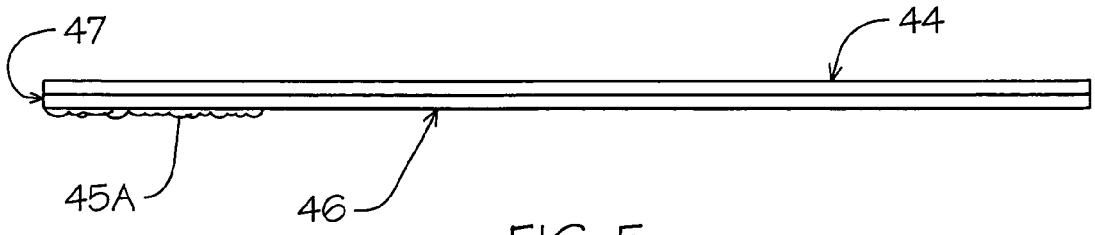
FIG. 5 is a side elevational view thereof.

The soft top foot engagement portion 12 of the invention is configured from a resilient cloth foam material sheet 42 shown in broken lines by tracing at 43 the patient's foot 14 or a shoe insert (not shown) if available. The configured orthotic plate 35 is then applied and its outlined traced at 45 over the shoe/foot outline and then cut to become a shaped soft top 44 as seen generally in FIGS. 4, 5 and 6 of the drawings.

Figure 6:
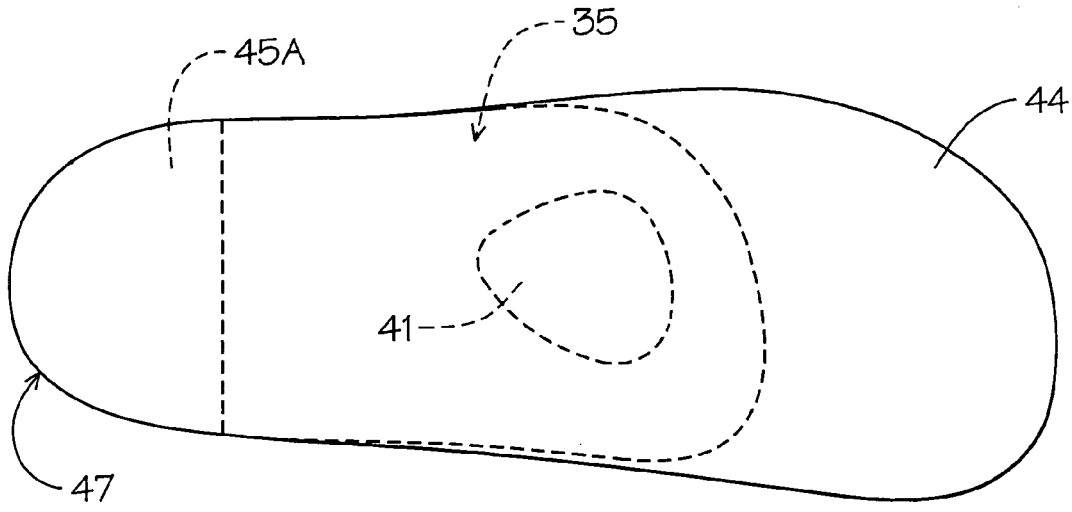
FIG. 6 is a top plan view of the completed customized moldable orthotic shell with a custom soft top and a transverse arch assembly.

Hook 45A and loop 45B registerable engaged material commercially available and known under the Velcro® trademark is adhesively secured respectively to an underside surface 46 portion of the soft top 44 extending inwardly from a "heel end" 47 thereof. The corresponding loop portion 45B is adhesively secured to the upper surface 33A of the configured orthotic plate 35 for registerable alignment with the corresponding hook material 45A when the overlying soft top 44 is positioned thereover and secured thereon thus completing the custom foot orthotic assembly 10 of the invention as seen in FIG. 6 of the drawings.

It will be noted that the orthopedic orthotic blank 13 is available in different dimensional sizes, shapes and thicknesses to accommodate a variety of foot sizes required and specific rigidity dependent on the patient's weight.

An example of same would be a semi-rigid reinforcement plate material for a patient under 225 pounds and a rigid reinforcement plate blank material for those over 225 pounds. A flexible plate (not shown) would be indicated for children (not shown) or for tight fitting shoe applications It will be seen that by combining the custom molded hard support shell portion 11 so configured as the configured orthotic plate 35 with the removably secured foot engagement portion 12 fabricated as the soft top 44 will provide for a true custom foot orthotic device that can be used in virtually all the shoes of the patient as hereinbefore described.

It will thus be seen that a new and novel "in house" custom foot orthotic forming system and apparatus has been illustrated and described and it will be apparent to those skilled in the art that various changes and modifications may be made thereto without departing from the spirit of the invention.

Therefore I claim:

1. A method of forming a two-part orthotic insert for an article of footwear having a hard shell portion and a soft overlying portion, method steps of forming said hard shell portion comprises, a. locating and marking the centered highest point of the medial longitudinal arch and lateral longitudinal arch position on a patient's foot, b. locating and marking the posterior distal portion of the metatarsal bones positioned on the bottom of a patient's foot, c. locating and marking the first and fifth metatarsal-phalangeal joints on the patient's foot, d. selecting an orthotic blank to be formed under the method, e. positioning a patient's leg and foot in a sitting angular specific position, f. positioning a resilient mat for future engagement with said patient's foot and positioning a silicone sheet thereon, g. heating said selected orthotic blank to a malleable temperature in a heat source, h. positioning said heated orthotic blank on said resilient mat, i. placing a heat shield on said heated orthotic blank, j. positioning the patient's foot on said heat shield and said orthotic blank, k. instructing the patient to extend the toes up to maximize the medial and lateral longitudinal arch if needed, l. applying an upward superior force against the medial and lateral longitudinal arches forming the medial and lateral arches of the foot via the mat and aligned orthotic blank against the underside of a patient's foot deforming said orthotic blank in compliance therewith, m. applying an upward superior force against the medial and lateral portions of the hindfoot forming a customized cup for the heel, n. repositioning said patient's foot to a heel up position, applying downward pressure to the mid and forefoot area of the foot on said orthotic blank, o. removing a custom formed orthotic plate from the patient's foot and cooling, p. repositioning the patient's foot on said cooled custom formed orthotic plate and marking thereon corresponding to said patient's first and fifth metatarsal-phalangeal joint location marking on said foot as set forth in step "c", q. tracing the patient's foot outline and marking same on said custom formed orthotic plate and interconnecting said transferred first and fifth metatarsal-phalangeal joint marks with a straight line, r. cutting and shaping said marked custom formed orthotic plate in accordance with said outline markings, s. contact transferring of location marks applied to the bottom of the foot corresponding to said distal posterior bottom portions of the first, fifth and a third metatarsal-phalangeal joint from said patient's foot to an upper foot effacing surface of said custom formed orthotic plate, t. selecting, sizing and attaching a transverse arch pad to said custom formed orthotic plate locations as set forth in step "s", u. securing a releasable fastener to said upper surface of said custom formed orthotic plate in spaced longitudinal relation to said transverse arch pad as set forth in steps "t".

2. The method of forming a two-part orthotic insert set forth in claim 1 wherein said soft overlying portion comprises the steps of, a. making the outline of a patient's foot on a sheet of composite yielding flexible synthetic resin foam material, b. positioning the custom formed orthotic plate set forth in claim 1 on said foam resin material and tracing the outline thereon, c. cutting the synthetic resin foam material along said corresponding foot and custom foot orthotic plate outlining thereon defining a soft top, d. attaching a releasable fastener on a portion of said soft top for a corresponding engageable alignment with said fastener on said custom foot orthotic plate.

3. The method of forming a two-part orthotic insert set forth in claim 1 wherein said selecting an orthotic blank to be so formed comprises the steps of, a. determining foot size and weight of patient, b. positioning the patient's foot on an orthotic blank, c. trimming length of orthotic blank on the back of a heel portion on said foot to said first metatarsal phalangeal joint indicated in claim 1.

4. The method of forming a two-part orthotic insert set forth in claim 1 wherein said step of positioning a patient's leg and foot in a sitting angular specific position comprises, a. aligning a patient's knee so the lower leg is at a ninety degree angle to the horizontal plane of an upper leg portion of said patient, b. positioning the knee medially in relation to the foot to accommodate for outward bowing of patient's Achilles tendon, c. positioning the knee laterally in relation to the foot to accommodate for inward bowing of the patient's Achilles tendon.

5. The method of forming a two-part orthotic insert set forth in claim 1 wherein said step of heating the selected orthotic blank further comprises, a. positioning a silicone sheet on a transfer tray and said orthotic blank thereon, b. positioning said transfer tray in a heat chamber at 400 degrees for a predetermined time.

6. The method of forming a two-part orthotic insert set forth in claim 1 wherein said step of applying upper force against the mat and aligned orthotic blank thereon comprises, a. manually engaging said mat under the medial longitudinal arch position of said patient's foot with an insulated glove hand, b. manually engaging said mat under the longitudinal arch position of said patient's foot with said gloved hand, c. stabilizing said patient's foot by contacting against the top foot portion of the practitioner's other gloved hand.

7. The method of forming a two-part orthotic insert set forth in claim 1 wherein applying pressure to said patient's foot position set forth in claim 1, comprises, manually engaging said patient's foot with an insulated gloved hand.

* * * * *